US008043779B2

(12) United States Patent
Yasunaga et al.

(10) Patent No.: US 8,043,779 B2
(45) Date of Patent: Oct. 25, 2011

(54) PULVERIZED TONER

(75) Inventors: Hideaki Yasunaga, Ibaraki (JP); Hiroaki Kato, Nagaokakyo (JP); Masayuki Hagi, Minoo (JP); Katsunori Kurose, Takarazuka (JP); Yoshihiro Mikuriya, Nishinomiya (JP); Yoshimichi Ishikawa, Itami (JP); Atsushi Yamamoto, Kawanishi (JP); Takuya Kadota, Kobe (JP)

(73) Assignee: Ricoh Company, Ltd., Tokyo (JP)

( * ) Notice: Subject to any disclaimer, the term of this patent is extended or adjusted under 35 U.S.C. 154(b) by 862 days.

(21) Appl. No.: 11/684,131

(22) Filed: Mar. 9, 2007

(65) Prior Publication Data

US 2007/0212630 A1 Sep. 13, 2007

(30) Foreign Application Priority Data

Mar. 10, 2006 (JP) ..... 2006-066271

(51) Int. Cl.
*G03G 9/087* (2006.01)

(52) U.S. Cl. ..... 430/108.7; 430/111.4; 430/110.3; 430/108.1

(58) Field of Classification Search ..... 430/111.4, 430/108.7, 108.1, 110.3, 123.5
See application file for complete search history.

(56) References Cited

U.S. PATENT DOCUMENTS

| | | | | |
|---|---|---|---|---|
| 5,700,616 | A * | 12/1997 | Kasuya et al. | 430/108.7 |
| 6,087,059 | A * | 7/2000 | Duggan et al. | 430/108.7 |
| 6,203,960 | B1 * | 3/2001 | Ciccarelli et al. | 430/108.7 |
| 2003/0152857 | A1 * | 8/2003 | Sugiura et al. | 430/108.1 |
| 2004/0053155 | A1 * | 3/2004 | Emoto et al. | 430/110.3 |
| 2004/0115553 | A1 * | 6/2004 | Yamanouchi et al. | 430/111.4 |
| 2006/0204882 | A1 | 9/2006 | Nozaki et al. | |
| 2006/0210902 | A1 | 9/2006 | Nakamura et al. | |
| 2006/0275686 | A1 | 12/2006 | Kadota et al. | |
| 2008/0199234 | A1 | 8/2008 | Hagi et al. | |

FOREIGN PATENT DOCUMENTS

| | | |
|---|---|---|
| JP | 11-295928 | 10/1999 |
| JP | 2000-3063 | 1/2000 |
| JP | 2002-169326 | 6/2002 |
| JP | 2003-202696 | 7/2003 |
| JP | 2004-46073 | 2/2004 |
| JP | 2004-109602 | 4/2004 |
| JP | 2006113616 A * | 4/2006 |

OTHER PUBLICATIONS

Le Système international d'unités (SI), 8th edition, English version. Bureau international des poids et mesures, Paris, (2006).*
Diamond, Arthur S & David Weiss (eds.) Handbook of Imaging Materials, 2nd ed.. New York: Marcel-Dekker, Inc. (Nov. 2001) pp. 145-164.*
Keijiro Terashita et al., "Preparation of Antipyretic Analgesic by Direct Compression and Its Evaluation", Chem. Pharm. Bull. 50(12), pp. 1542-1549 (2002).*
Aoki, Takayoshi. "Chemical Toner Technology and the Future" IS&T's NIP 19. Springfield, Virginia, pp. 2-5, (2003).*
U.S. Appl. No. 12/027,704, filed Feb. 7, 2008, Fuwa, et al.
U.S. Appl. No. 12/241,656, filed Sep. 30, 2008, Yasunaga, et al.
U.S. Appl. No. 12/017,853, filed Jan. 22, 2008, Masumoto, et al.
U.S. Appl. No. 12/026,057, filed Feb. 5, 2008, Nozaki, et al.
U.S. Appl. No. 12/048,689, filed Mar. 14, 2008, Kadota, et al.
U.S. Appl. No. 12/049,719, filed Mar. 17, 2008, Yamamoto, et al.
U.S. Appl. No. 12/050,963, filed Mar. 19, 2008, Ishikawa, et al.
U.S. Appl. No. 12/051,248, filed Mar. 19, 2008, Hagi, et al.
U.S. Appl. No. 12/046,869, filed Mar. 12, 2008, Nozaki, et al.
U.S. Appl. No. 12/048,865, filed Mar. 14, 2008, Yasunaga, et al.
U.S. Appl. No. 11/670,257, filed Feb. 1, 2007, Hagi, et al.
U.S. Appl. No. 12/197,651, filed Aug. 25, 2008, Katoh, et al.
U.S. Appl. No. 12/010,369, filed Jan. 24, 2008, Yasunaga, et al.
U.S. Appl. No. 11/965,522, filed Dec. 27, 2007, Fuwa, et al.
U.S. Appl. No. 12/342,656, filed Dec. 23, 2008, Fuwa, et al.
U.S. Appl. No. 11/963,279, filed Dec. 21, 2007, Mikuriya, et al.

* cited by examiner

*Primary Examiner* — Christopher Rodee
(74) *Attorney, Agent, or Firm* — Oblon, Spivak, McClelland, Maier & Neustadt, L.L.P.

(57) ABSTRACT

To provide a pulverized toner excellent in the releasing ability and cleaning ability, and an image-forming apparatus for one-component developer, and a process cartridge using the pulverized toner. The pulverized toner contains a toner base particle containing at least a binder resin, a colorant, and a releasing agent, the mass ratio of the releasing agent to the binder resin is 3.0% to 6.0%, the adhesive force among the pulverized toners at 25° C. to 55° C. is 20 g to 80 g, and the pulverized toner is used for the image-forming apparatus for one-component developer containing the cleaning unit configured to dispose an elastic blade adjacent to the surface of the image bearing member so as to clean the surface.

10 Claims, 2 Drawing Sheets

PULVERIZED TONER

BACKGROUND OF THE INVENTION

1. Field of the Invention

The present invention relates to a pulverized toner, an image-forming apparatus for one-component developer and a process cartridge using the pulverized toner.

2. Description of the Related Art

In an oilless pulverized toner, wax is contained in the toner base particles, so that the interface of the pulverized toner tends to be generated where the wax exist. Thus, in general the oilless pulverized toner is easily affected by heat or stress, particularly the oilless pulverized toner is easily affected by the process using heat or applying stress in one-component developing process which is characterized by compact form.

In general, the polymerization toner encapsulating wax is used to ensure the resistance against heat or stress. The polymerization toner is characterized by uniformity of the particle size, and high circularity, thus, it is easy to achieve high image quality and lower production cost. On the other hand, the polymerization toner is inferior in cleaning ability. Thus, in a case of the toner produced by the conventional pulverization process, the pressing force applied to a surface of a photoconductor by an elastic blade is not enough to block the residual toner from passing through the blade, and much larger pressing force is necessary. With regard to the means for keeping the stable cleaning effect, there is a tendency that the friction coefficient of the electrophotographic photoconductor is decreased to improve the releasing ability of the toner with respect to the surface of the photoconductor, and many methods of incorporating a lubricant in a surface layer and a protective layer of an electrophotographic photoconductor are proposed. Examples of the lubricants include a fluorine resin such as polytetrafluoroethylene; resin powders such as a substantially spherical acrylic resin, and polyethylene resin; metallic oxide powders such as silicon oxide, and aluminum oxide. The means for decreasing the friction coefficient of the photoconductor at early stage has been put into practical use; for example, a coating mechanism is placed near the contact part of an elastic blade with a photoconductor to coat a toner or a lubricant, and a lubricant layer is disposed on the surface of the photoconductor. In addition, for the combined blade material, the blade material having relatively low impact resilience is likely to be used in order that the contact part with a photoconductor suppresses the vibration generated by the frictional force between the contact part and the photoconductor thereby to prevent the change of toner blocking property, noise, and fluttering sound.

However, it has been confirmed that the toner produced by adding a releasing component in the toner base particles beforehand to improve the releasing ability when fixing is likely to have higher adhesive force. Therefore, it is difficult to discharge a residual toner, which accumulates easily, after a visible image is formed on the photoconductor in a developing unit and transferred in a transferring unit, and then the residual toner on the photoconductor is blocked at the contact part of the cleaning blade with the photoconductor.

When the toner accumulation is increased at the contact part of the cleaning blade with the photoconductor, the pressing force of the toner partly exceeds blocking force of the blade, and then the toner passes through the contact part of the cleaning blade with the photoconductor. Thus, the problem of the inferior cleaning ability is frequently occurred.

Japanese Patent Application Laid-Open (JP-A) No. 2004-109602 discloses the toner in which the relation of the adhesive stress at 25° C. and 50° C. are defined. The toner is produced by salting out/fusion bonding resin particles and colorant particles in an aqueous medium, not by the melt-kneading pulverization.

Japanese Patent Application Laid-Open (JP-A) No. 2002-169326 discloses the toner in which the relation of the amount of the external additive to the toner particle diameter, and the relation of the adhesive stress to the compressive force are defined. The oilless pulverized toner needs more amount of the external additive to coat the surface of the toner. In the definition of the relation of the change to the compressive force, the exudation of the releasing agent at high temperature and high pressure, which is the inherent problem of the oilless pulverized toner, can not be improved.

Japanese Patent Application Laid-Open (JP-A) No. 2000-3063 discloses the spherical toner having the relative high-circularity of 0.960 or more, however, the adhesive stress relative to the temperature is not defined. Thus, the exudation of the releasing agent at high temperature and high pressure, which is the inherent problem of the oilless pulverized toner, can not be improved.

Japanese Patent Application Laid-Open (JP-A) No. 11-295928 discloses the toner in which the adhesive force among toners and the softening point of the binder resin at a room temperature is defined, however, the adhesive stress relative to the temperature is not defined. Thus, the exudation of the releasing agent at high temperature and high pressure, which is the inherent problem of the oilless pulverized toner, can not be improved.

BRIEF SUMMARY OF THE INVENTION

An object of the present invention is to provide a pulverized toner excellent in releasing ability and cleaning ability, an image-forming apparatus for one developer, and a process cartridge using the toner.

The above-mentioned problems are solved by the following <1> to <11>.

<1> A pulverized toner containing: a toner base particle, wherein the toner base particle contains at least a binder resin, a colorant, and a releasing agent, and the mass ratio of the releasing agent to the binder resin is 3.0% to 6.0%, wherein the adhesive force among the pulverized toners at 25° C. to 55° C. is 20 g to 80 g 400 $N/m^2$ to 1600 $N/m^2$, wherein the pulverized toner is used for an image-forming apparatus for one-component developer containing a cleaning unit configured to dispose an elastic blade adjacent to the surface of an image bearing member so as to clean the surface.

<2> The pulverized toner according to <1>, wherein the volume average particle diameter is 6 μm to 10 μm, and the average circularity is 0.900 to 0.930.

<3> The pulverized toner according to <1>, further contains an inorganic particle, wherein the amount of the inorganic particle is 2.5 mass % to 6.0 mass %.

<4> The pulverized toner according to <3>, wherein the inorganic particle contains a silica having the average primary particle diameter of 10 nm to 60 nm.

<5> The pulverized toner according to <3>, wherein the inorganic particle contains a first silica having the average primary particle diameter of 10 nm to 20 nm, and a second silica having the average primary particle diameter of 25 nm to 60 nm.

<6> The pulverized toner according to <5>, wherein the mass ratio of the first silica to the second silica is 1/4 to 2/3.

<7> The pulverized toner according to <3>, wherein the adhesive force of the inorganic particle to the toner base particle is 30% to 60%.

<8> The pulverized toner according to <1>, wherein the ratio of the adhesive force among the pulverized toners at 55° C. to the adhesive force among the pulverized toners at 25° C. is 1.1 to 2.5, 1.4 to 2.5, 1.6 to 2.5, or 1.9 to 2.5.

<9> The pulverized toner according to <1>, wherein the pulverized toner is used for oilless fixing.

<10> An image-forming apparatus for one-component developer containing: an image bearing member, and a cleaning unit configured to dispose an elastic blade adjacent to the surface of the image bearing member so as to clean the surface, wherein the image-forming apparatus for one-component developer uses a pulverized toner to form an image, wherein the pulverized toner contains a toner base particle, the toner base particle contains at least a binder resin, a colorant, and a releasing agent, the mass ratio of the releasing agent to the binder resin is 3.0% to 6.0%, and the adhesive force among the pulverized toners at 25° C. to 55° C. is 20 g to 80 g (400 $N/m^2$ to 1600 $N/m^2$).

<11> A process cartridge containing: an image bearing member, a developing unit configured to develop a latent electrostatic image using a pulverized toner, and a cleaning unit configured to dispose an elastic blade adjacent to the surface of the image bearing member so as to clean the surface, wherein the process cartridge integrally supports at least the image bearing member, the developing unit, and the cleaning unit, and is detachably attached to an image-forming apparatus for one-component developer, wherein the pulverized toner contains a toner base particle, wherein the toner base particle contains at least a binder resin, a colorant, and a releasing agent, the mass ratio of the releasing agent to the binder resin is 3.0% to 6.0%, and the adhesive force among the pulverized toners at 25° C. to 55° C. is 20 g to 80 g (400 $N/m^2$ to 1600 $N/m^2$).

The present invention can provide a pulverized toner excellent in the releasing ability and cleaning ability, an image-forming apparatus for one-component developer and a process cartridge using the toner.

DETAILED DESCRIPTION OF THE INVENTION

Figure 1:
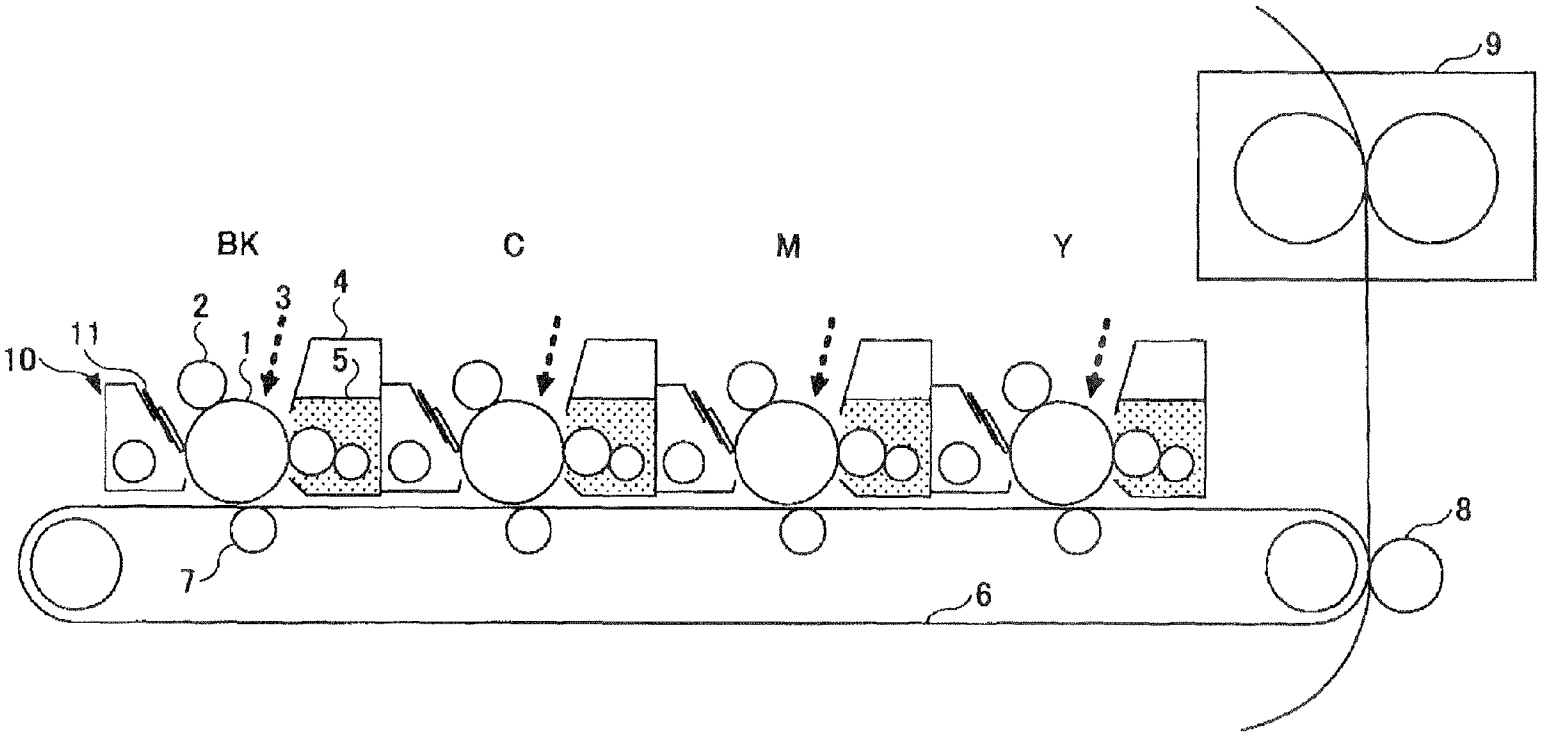
FIG. 1 shows an example of an image-forming apparatus of the present invention.

The present invention will be explained with reference to the preferred embodiments, to which the present invention is not to be limited, since those skilled in the art may easily change or modify them within the scope of the present invention defined in claims.

The pulverized toner of the present invention (hereinafter, referred to as "toner") is used in an image-forming apparatus for one-component developer containing a cleaning unit configured to dispose a plate-like elastic blade adjacent to the surface of the image bearing member so as to clean the surface, wherein the toner contains toner base particles containing at least a binder resin, a colorant, and a releasing agent, the mass ratio of the releasing agent to the binder resin is 3.0% to 6.0%, and the adhesive force among the pulverized toners at 25° C. to 55° C. is 20 g to 80 g (400 $N/m^2$ to 1600 $N/m^2$).

When the mass ratio of the releasing agent to the binder resin is less than 3.0%, the separation property of a paper may be reduced and the paper cannot be transferred. When the mass ratio of the releasing agent to the binder resin is more than 6.0%, the amount of the releasing agent on the surface of the toner may be increased and toners tend to aggregate with one another, and the residual toner may not be removed completely in the cleaning blade part.

When the adhesive force among the pulverized toners at 25° C. to 55° C. is less than 20 g (400 $N/m^2$), the pulverized toner for oilless fixing may be hard to be produced. When the adhesive force among the pulverized toners at 25° C. to 55° C. is more than 80 g (1600 $N/m^2$), the toners aggregate with one another, and the residual toner may not be removed completely in the cleaning blade part.

The adhesive force among toners is the value indicating the adhesive property among particles, which can be obtained measured by an AGGROBOT analytical device that is an automatic measuring system for compressive and tensile forces of powder beds manufactured by Hosokawa Micron Corporation. Specifically, adhesive force among toners is the strength measured, such that 7.0 g of the toner is filled in a cell having a diameter of 25 mm which is dividable into upper and lower parts, and a load of 8 kg is placed for 5 minutes and then the strength is obtained by lifting an upper cell. The temperature for measuring the adhesive force is the temperature of the cell, and can be controlled by a temperature controlling system equipped in the apparatus.

The toner of the invention preferably has a volume average particle diameter of 6 μm to 10 μm and the average circularity of 0.900 to 0.930. When the volume average particle diameter is less than 6 μm, it may be hard to produce the toner by a pulverization method. When the volume average particle diameter is more than 10 μm, the image quality may be reduced. It may be sometimes hard to produce the pulverized toner having the average circularity of less than 0.900 and more than 0.930.

The particle size distribution of the toner can be measured by a Coulter counter method. Examples of the measuring equipments include Coulter counter TA-II, and Coulter multisizer II (both are manufactured by Beckman Coulter, Inc.). The measuring method is as follows: first, 0.1 ml to 5 ml of a surfactant (preferably, alkylbenzene sulfonate) is added to 100 ml to 150 ml of electrolytic solution as a dispersant. The electrolytic solution is a 1 mass % aqueous solution of NaCl prepared using primary sodium chloride, for example, ISOTON-II manufactured by Beckman Coulter, Inc. 2 mg to 20 mg of the measurement sample is further added in terms of a solid content. The electrolytic solution in which the sample is suspended is subject to dispersion treatment for approximately 1 minute to 3 minutes using an ultrasonic disperser and the volume and number of the toner are measured by means of the measuring equipment, employing an aperture of 100 μm to calculate volume and number distributions. The volume average particle diameter and number average particle diameter could be obtained from the resulting distributions. As channels, 13 channels are used: 2.00 μm to less than 2.521 μm; 2.52 μm to less than 3.17 μm; 3.17 μm to less than 4.00 μm; 4.00 μm to less than 5.04 μm; 5.04 μm to less than 6.35 μm; 6.35 μm to less than 8.00 μm; 8.00 μm to less than 10.08 μm; 10.08 μm to less than 12.70 μm; 12.70 μm to less than 16.00 μm; 16.00 μm to less than 20.20 μm; 20.20 μm to less than 25.40 μm; 25.40 μm to less than 32.00 μm; 32.00 μm to less than 40.30 μm. The particles having the particle diameter of 2.00 μm to less than 40.30 μm are surveyed.

The toner of the invention contains much more inorganic particles, and the amount of the inorganic particles is preferably 2.5 mass % to 6.0 mass %. When the amount of the inorganic particles is less than 2.5 mass %, the inorganic particles may not sufficiently coat the surface of the toner, so that the toners tend to aggregate with one another, and sometimes adhere to a function member and the like. When the amount of the inorganic particles is more than 6.0 mass %, the inorganic particles are released from the surface of the toner, and then cause image noise.

In the present invention, the inorganic particle is preferably a silica having an average primary particle diameter of 10 nm to 60 nm. When the average primary particle diameter is less than 10 nm, the inorganic particles are likely to be buried in the toner base particles, the flowability of the toner may sometimes change greatly. When the average primary particle diameter is more than 60 nm, it may be difficult for the inorganic particles to adhere to the toner base particles, and the released fine particles may generate image noise.

In the present invention, the inorganic particles preferably consist of a first silica having an average primary particle diameter of 10 nm to 20 nm, and a second silica having an average primary particle diameter of 25 nm to 60 nm. Thus, the first silica can coat thinly the surface of the toner, which allows not to be buried easily in the toner base particles, and the second silica can work effectively as a spacer.

In the present invention, the mass ratio of the first silica to the second silica is preferably 1/4 to 2/3. When the mass ratio is less than 1/4, it may be difficult for the first silica to coat thinly the surface of the toner, and the second silica may become released fine particles and then cause image noise. When the mass ratio is more than 2/3, the first silica may become released fine particles, which cause image noise, and the second silica may work less effectively as a spacer.

In the present invention, the adhesive force of the inorganic particles to the toner base particles is preferably 30% to 60%. When the adhesive force of the inorganic particles to the toner base particles is less than 30%, the released fine particles may increase and then cause image noise. When the adhesive force of the inorganic particles to the toner base particles is more than 60%, the inorganic particles may be fixed in the toner base particles, and the flowability may not be obtained sufficiently.

The adhesive force of the inorganic particles to the toner base particles is obtained by such a manner that 2 g of the toner is blended enough in 30 cc of a surfactant solution diluted by ten times, and then the toner is separated out by energizing at 40 W for 1 hour by an ultrasonic homogenizer, subsequently washed and dried, and then the ratio of the adhered amount of the inorganic particles after processing to that before processing is calculated using an x-ray fluorescence spectrometer. The fluorescent X-ray analysis is performed in such a manner that 2 g of the processed dried toner and 2 g of the toner before processing are respectively made into pellets by applying the load of $1N/cm^2$ for 60 sec., and then the inherent element of the inorganic particles, for example, silicon in the case of silica, is determined quantitatively by calibration curve method using a wavelength-dispersive x-ray fluorescence spectrometer XRF1700 manufactured by Shimazu Corporation.

In the present invention, the ratio (F55/F25) of the adhesive force F55 among toner base particles at 55° C. to the adhesive force F25 among toner base particles at 25° C. is preferably 1.1 to 2.5. When the ratio is less than 1.1, it may be difficult to produce the oilless pulverized toner. When the ratio is more than 2.5, the adhesive force may vary greatly by the temperature, and the toners may aggregate with one another at high temperature, thus residual toner may remain in the cleaning blade.

In the present invention, a predetermined amount of an external additive having the defined particle diameter is fixed firmly on the surface of the oilless pulverized toner, so that the resistant to heat and stress is improved. In order to achieve the heat- and stress-resistant oilless pulverized toner, the amount of the external additive sufficient enough to coat the surface of the toner is fixed with the optimal adhesive force. When the particle diameter of the external additive is larger, the effect can be expected. However, when it is too large, it may be hard to fix on the toner base particles. When the particle diameter of the external additive is smaller, the external additive easily fixes on the toner base particles, but also buries rapidly, thus the resistance cannot be expected. Basically, the effect can be achieved by fixing medium sized particles to some extend. Examples of the method of fixing the external additive include fixing by HENSCHEL MIXER. The circumferential speed, shape of a blade, temperature of HENSCHEL MIXER, deflector angle, and process time are adjusted to promote the fixation. However, the excess promotion leads to the rapid toner temperature rise, and the toner may be melted by the frictional heat. It is necessary to select appropriately the combination of the means for accelerating fixation in order to fix the predetermined amount of external additive on the surface of the toner while the temperature of the toner is not raised. Basically, it can be achieved by processing the certain external additive to the toner base particles in high-speed rotation with the standard blade, at a room temperature, for a long time.

In the present invention, the toner base particle in the toner contains a binder resin, a colorant, a releasing agent, and may further contains a charge controlling agent.

The binder resin is not particularly limited and may be appropriately selected depending on the intended purpose. Examples of the binder resins include styrenes and polymers of the substitution product thereof such as polystyrene, poly (p-chlorostyrene) and polyvinyltoluene; styrene copolymers such as a styrene-p-chlorostyrene copolymer, a styrene-propylene copolymer, a styrene-vinyltoluene copolymer, a styrene-methyl acrylate copolymer, a styrene-ethyl acrylate copolymer, a styrene-methacrylate copolymer, a styrene-methyl methacrylate copolymer, a styrene-ethyl methacrylate copolymer, a styrene-butyl methacrylate copolymer, a styrene-α-chloromethyl methacrylate copolymer, a styrene-acrylonitrile copolymer, a styrene-vinyl methyl ether copolymer, a styrene-vinyl methyl ketone copolymer, a styrene-butadiene copolymer, a styrene-isoprene copolymer, a styrene-maleate copolymer; polymethylmethacrylate, polybutylmethacrylate, polyvinyl chloride, polyvinyl acetate, polyethylene, a polyester resin, a polyurethane resin, an epoxy resin, a polyvinyl butyral resin, polyacrylic acid, rosin, modified rosin, a terpene resin, a phenol resin, an aliphatic or alicyclic hydrocarbon resin, and an aromatic petroleum resin. These may be used singly or in combination.

The colorant is not particularly limited and may be appropriately selected from the known dyes and pigments depending on the intended purpose. Examples thereof include carbon black, nigrosine dyes, iron black, Naphthol Yellow S, Hansa Yellow (10G, 5G, G), cadmium yellow, yellow iron oxide, yellow ocher, chrome yellow, Titan Yellow, Polyazo Yellow, Oil Yellow, Hansa Yellow (GR, A, RN, R), Pigment Yellow L, Benzidine Yellow (G, GR), Permanent Yellow (NCG), Vulcan Fast Yellow (5G, R), Tartrazine Lake, Quinoline Yellow Lake, anthracene yellow BGL, isoindolinone yellow, colcothar, red lead oxide, lead red, cadmium red, cadmium mercury red, antimony red, Permanent Red 4R, Para Red, Fire Red, parachlororthonitroaniline red, Lithol Fast Scarlet G, Brilliant Fast Scarlet, Brilliant Carmine BS, Permanent Red (F2R, F4R, FRL, FRLL, F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, eosine lake, Rhodamine Lake B, Rhodamine Lake Y, Alizarine Lake, Thioindigo Red B, Thioindigo Maroon, Oil Red, quinacridone red, Pyrazolone Red, Polyazo Red, Chrome Vermilion, Benzidine Orange, Perynone Orange, Oil Orange, cobalt blue, cerulean blue, Alkali Blue Lake, Peacock Blue Lake, Victoria Blue Lake, metal-free phthalocyanine blue, Phthalocyanine Blue, Fast Sky Blue, Indanthrene Blue (RS, BC), indigo, ultramarine, Prussian blue, Anthraquinone Blue, Fast Violet B, Methyl Violet Lake, cobalt violet, manganese violet, dioxazine violet, Anthraquinone Violet, chrome green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc white, and lithopone. These may be used singly or in combination.

The amount of the colorant in the toner base particles is preferably 1 mass % to 15 mass %, and more preferably 3 mass % to 10 mass %.

The colorant may be used as a master batch in a composite with a resin as well. The resins are not particularly limited and can be appropriately selected from those known in the art depending on the intended purpose. Examples thereof include a styrene and a polymer of the substitution product thereof, a styrene copolymer, polymethylmethacrylate, polybutylmethacrylate, polyvinyl chloride, polyvinyl acetate, polyethylene, polypropylene, a polyester resin, an epoxy resin, an epoxy polyol resin, a polyurethane resin, a polyamide resin, a polyvinyl butyral resin, polyacrylic acid, rosin, modified rosin, a terpene resin, an aliphatic or alicyclic hydrocarbon resin, an aromatic petroleum resin, a chlorinated paraffin and a paraffin. These resins may be used singly or in combination.

The releasing agent is not particularly limited and can be appropriately selected from those known in the art depending on the intended purpose. For example, wax may be used.

In general, lower polar wax is excellent in the releasing ability with respect to a fixing member roller. In the invention, a lower polar hydrocarbon wax is preferably used.

The hydrocarbon wax is the wax consisting of only carbon atoms and hydrogen atoms, and does not contain ester bond, hydroxyl group, amide bond and the like. Examples of the hydrocarbon wax include polyolefin wax such as polyethylene, polypropylene, a copolymer of ethylene and propylene; petroleum wax such as paraffin wax, and microcrystalline wax; synthesized wax such as Fischer-Tropsh wax. Among these, the polyethylene wax, the paraffin wax, and the Fischer-Tropsh wax are preferable, the polyethylene wax, and the paraffin wax are more preferable.

In the present invention, the melting point of the wax is the endothermic peak during temperature rise measured by means of a differential scanning calorimeter (DSC), and preferably at 70° C. to 90° C. When the melting point of the wax is more than 90° C., the wax may melt insufficiently in a fixing process, and sometimes lose separation property with respect to a fixing member. When the melting point of the wax is less than 70° C., some troubles may be caused in preservation stability, for example, toners melt and adhere with one another in a high temperature and high humidity environment. In order to ensure the stable separation property at low temperature, the melting point of the wax is still more preferably 70° C. to 85° C., and particularly preferably 70° C. to 80° C.

The half-value width of the endothermic peak of the wax during heating measured by a differential scanning calorimeter (DSC) is preferably 7° C. or less. In the present invention, the melting point of the wax is relatively low, thus, the wax has a broad endothermic peak, that is the wax melting at low temperature may adversely affect to the preservation stability of the toner.

The amount of the releasing agent in the toner base particles are not particularly limited and may be appropriately selected depending on the intended purpose. The amount of the releasing agent is preferably 1 mass % to 40 mass %, and more preferably 3 mass % to 30 mass %. When it is more than 40 mass %, the flowability of the toner may be reduced.

The charge controlling agent is not particularly limited and can be appropriately selected from those known in the art. The negative or positive charge controlling agent may be appropriately selected depending on the charge applied to the photoconductor.

For the negative charge controlling agent, for example, a resin, and a compound having an electron donating functional group, an azo dye, a metal organic acid complex and the like can be used. Examples of the negative charge controlling agents include Bontron (S-31, S-32, S-34, S-36, S-37, S-39, S-40, S-44, E-81, E-82, E-84, E-86, E-88, A, 1-A, 2-A, 3-A) manufactured by Orient Chemical Industries, Ltd.; Kayacharge (N-1, N-2), Kayaset Black (T-2, 004) manufactured by Nippon Kayaku Co., Ltd.; Aizen Spilon Black (T-37, T-77, T-95, TRH, TNS-2) manufactured by Hodogaya Chemical Co., LTD.; FCA-1001-N, FCA-1001-NB, FCA-1001-NZ manufactured by Fujikura Kasei Co., Ltd. These may be used singly or in combination.

For the positive charge controlling agent, for example, a basic compound such as a nigrosine dye, a cationic compound such as a quaternary ammonium compound, a metal salt of higher fatty acid and the like can be used. Examples of the positive charge controlling agents include Bontron (N-01, N-02, N-03, N-04, N-05, N-07, N-09, N-10, N-11, N-13, P-51, P-52, AFP-B) manufactured by Orient Chemical Industries, Ltd.; TP-302, TP-415, TP-4040 manufactured by Hodogaya Chemical Co., Ltd.; Copy Blue PR, Copy Charge (PX-VP-435, NX-VP-434) manufactured by Hoechst is Ltd.; FCA (201, 201-B-1, 201-B-2, 201-B-3, 201-PB, 201-PZ, 301) manufactured by Fujikura Kasei Co., Ltd.; PLZ (1001, 2001, 6001, 7001) manufactured by Shikoku Chemicals Corporation. These may be used singly or in combination.

The amount of the charge controlling agent is not limited and depends on the method for producing the toner base particles including the kinds and dispersing methods of the binder resin. The amount of the charge controlling agent is preferably 0.1 parts by mass to 10 parts by mass, and more preferably 0.2 parts by mass to 5 parts by mass based on 100 parts by mass of the binder resin. When the amount exceeds 10 parts by mass, the charge property of the toner is too big and then the effect of the charge controlling agent is reduced, and the static charge attraction with respect to the developing roller is increased. Thus, the flowability of the developer may be reduced and the image density may be decreased. When the amount is less than 0.1 parts by mass, the charge rise property and the amount of the charge may be insufficient, and this may easily affect the toner image.

The toner of the invention can contain inorganic particles as an additive to assist flowability and developing property in addition to the above-mentioned inorganic particles. Examples of the external additives include silicon oxide, zinc oxide, tin oxide, silica sand, titanium oxide, clay, mica, wollastonite, diatom earth, chrome oxide, cerium oxide, colcothar, antimony trioxide, magnesium oxide, zirconium oxide, barium sulfate, barium carbonate, calcium carbonate, silicon carbide and silicon nitride.

In the present invention, the amount of the external additive is preferably 2.5 parts by mass to 6.0 parts by mass based on 100 parts by mass of the toner base particles. When the amount of the external additive exceeds 6.0 parts by mass, fog may occur, and the developing property and stable separation property may be adversely affected. When the amount of the external additive is less than 2.5 parts by mass, the flowability, transferring property, and heat-resistant storage property may be adversely affected.

Next, the method for producing the toner base particles will be explained. First, the mixture of the material for toner base particles is put in a melting kneader, and melt-kneaded. As the melting kneader, it is possible to use a uniaxis or two-axis-consecutive kneader, and a batch type kneader using a roll mill. For example, KTK type two-axis extruder manufactured by Kobe Steel, Ltd.; a TEM type two-axis extruder manufactured by Toshiba Machine Co., Ltd.; a two-axis extruder manufactured by KCK; a PCM type two-axis extruder manufactured by Ikegai, Ltd.; and a Co-kneader manufactured by Buss are used. It is preferred that these melting kneaders be used under appropriate conditions that does not bring separation of molecular chain of the binder resin. Specifically, when the melt-kneading temperature is excessively higher than the softening point of the binder resin, molecular chains are bitterly separated. When the melt-kneading temperature may be excessively lower than the softening point of the binder resin, the melt-kneading may not proceed.

Then, a kneaded product obtained in the melt-kneading is pulverized. Specifically, in the pulverization, it is preferred that the obtained kneaded product be coarsely crushed and then finely pulverized. Examples of the pulverizing methods include a method in which a kneaded product is made collided with a collision plate in a jet stream, a method in which particles are made collided with one another in a jet stream, and a method in which a kneaded product is pulverized in a gap between a mechanically rotating rotor and a stator.

The resulting pulverized product is classified and controlled to the predetermined particle diameters. For example, the classification of the particles can be performed by removing fine particles using a cyclone, a decanter, a centrifugal separator, and the like. Further, the toner base particles can be obtained by removing coarse particles and agglomerated particles with the 250 or greater mesh sieve.

Next, the method for adding and mixing the inorganic particles in the thus produced toner base particles. The mixers commonly used for fine particles are used for mixing the inorganic particles. However, it is preferred that the inside temperature can be controlled by an equipped jacket and the like. The inorganic particles are added gradually or in the middle of the process to change the history of load applied to the additive. Alternatively, the rotation frequency, rolling speed, time, temperature and the like may be changed. In addition, a relative weak load may be applied after a strong load is applied, and vice versa. Examples of the mixer include a V-type mixer, a rocking mixer, a Loedge mixer, a Nauter mixer, and a HENSCHEL MIXER.

The image-forming apparatus for one-component developer of the invention (hereinafter, referred to as "image-forming apparatus") is the image-forming apparatus using the toner of the invention, and contains a cleaning unit configured to dispose a plate-like elastic blade adjacent to the surface of the image bearing member so as to clean the surface.

FIG. 1 shows an example of an image-forming apparatus of the present invention. An image bearing member 1 can be rotatably driven. First, the surface of the image bearing member 1 is charged uniformly by a charging unit 2. Then, the surface of the image bearing member 1 is exposed to a laser beam 3 by an optical system for exposing, so as to form a latent electrostatic image on the image bearing member 1. A developer 5 in a developing unit 4 is transferred to the surface of the image bearing member 1 to form a visible image on the image bearing member 1.

Next, in a contact part between an intermediate transferring member 6 and the image bearing member 1, the developer 5 on the surface of the image bearing member 1 is transferred to the surface of the intermediate transferring member 6 by a primary transferring roller 7 disposed inside of the intermediate transferring member 6.

The transferred developer is transferred onto a recording medium by a secondary transferring roller 8, and then supplied to a fixing unit 9 so as to fix a toner image on the recording medium. On the other hand, the developer 5 remained on the surface of the image bearing member 1 is cleaned by a cleaning blade 11 in a cleaning unit 10.

The blade in the cleaning blade is a plate-form elastic member made of polyurethane which is mounted on a support, and configured to press so as to contact with the surface of the image bearing member. Thus, the contact pressure of the blade to the image bearing member needs to be increased to improve the accuracy of cleaning the toner. The contact manner of the blade to the image bearing member is in a forward direction or a counter direction of a rotation direction of the image bearing member. From the viewpoint of cleaning accuracy and the reduction of the pressing force applied to the blade, the counter direction is preferable.

Figure 2:
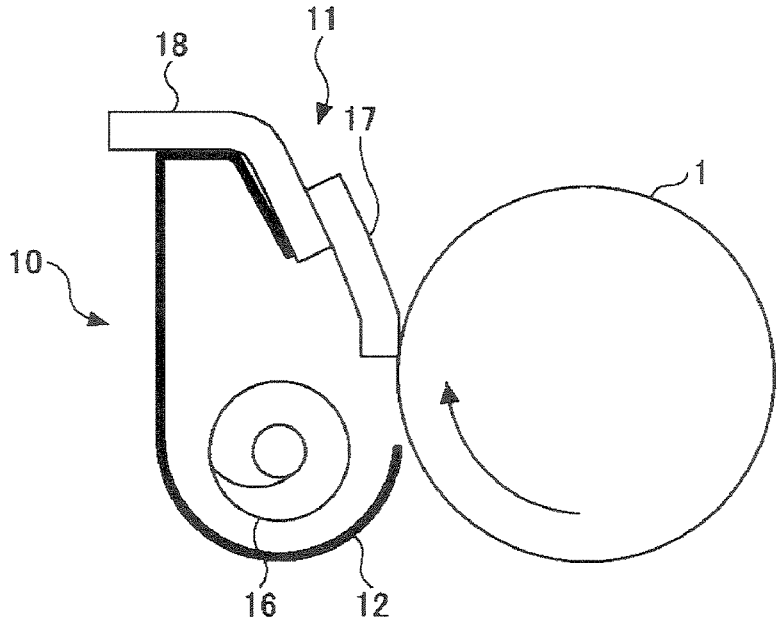
FIG. 2 shows an example of a cleaning unit used in the present invention.
Figure 3:
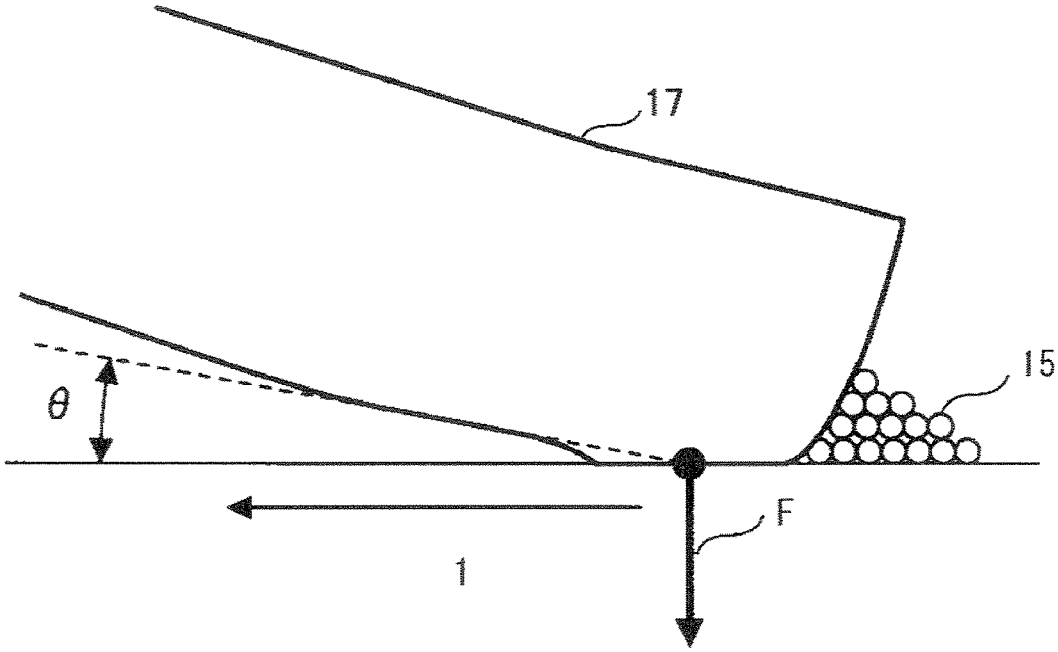
FIG. 3 is an example of a detailed illustration of the cleaning unit shown in FIG. 2.

FIG. 2 shows an example of a cleaning unit used in the present invention. FIG. 3 is an example of a detailed illustration of the cleaning unit. In FIG. 2, the cleaning unit 10, which is used to clean the toner attached to the surface of the image bearing member 1, consists of a toner retrieving case 12, the cleaning blade 11, and a screw 16 which moves the retrieved toner. The cleaning blade 11 consists of a plate-form elastic blade 17 and a support member 18 which supports the plate-form elastic blade 17. The plate-form elastic blade 17 is pressed onto the surface of the image bearing member 1 at a constant pressure. With reference to FIG. 3, the plate-form elastic blade 17 is pressed to contact with the surface of the image bearing member 1 at a predetermined contact angle θ by a biasing means such as a spring in order to retrieve the residual toner 15, while the image bearing member 1 rotates in an arrow direction. The pressing force F acts as the shown direction.

The materials used for the elastic blade can be appropriately selected from thermoplastic resins such as urethane, styrene, olefin, vinyl chloride, polyester, polyamide, and fluorine, which are commonly used in the conventional plate-like blade. The preferable material has the hardness (JIS-A) of 60 to 80, the elongation of 300% to 350%, the permanent elongation of 1.0% to 5.0%, and the modulus at 300% of 100 $kg/cm^2$ to 350 $kg/cm^2$. Particularly, the impact resilience of 35% or more results in the excellent cleaning effect, the response becomes better by the behavior of the vibration at the contact part of the elastic blade with the image bearing member, which is resulted by giving the high rebound resilience to the elastic blade, thus, the residual toners can be effectively removed. In the present invention, in view of the noise made by the vibration of the elastic blade at high temperature and high humidity, the rebound resilience of 35% or more is preferably used.

The elastic blade is stuck on the support member and disposed in the cleaning unit. The material of the support member is not limited, and can be appropriately selected depending on the purpose. Examples thereof include metals, plastics, and ceramics. The metal plate is preferable due to a certain degree of loaded strength. A steel plate such as SUS, an aluminium plate, and a phosphor-bronze plate are particularly preferable.

The setting condition of contacting the elastic blade with the image bearing member is that the contact angle θ in FIG. 3 is normally 5° or more, and more preferably 7° to 20°. In addition, to improve the effect of the behavior in the contact part of the elastic blade, the contact angle is still preferably 10° or more, and particularly preferably 10° to 15°.

In the present invention, in order to remove the accumulated toner by activating the behavior of the contact part of the elastic blade with the image bearing member, it is preferred that the surface property easily cause the vibration in the contact part of the elastic blade, that is, the surface friction coefficient is increased, to accelerate the vibration in the contact part of the elastic blade by the frictional force. Specifically, the static friction coefficient of the surface of the image bearing member measured by the oiler belt method is preferably 0.5 or more. Thus, the accumulated toner remained near the contact part of the elastic blade is reduced, and the effect for inhibiting the cleaning defect can be improved.

The material, shape, structure, size, and several features of the image bearing member are not particularly limited, and can be appropriately selected from those known in the art. However, the shape is preferably drum shaped. Examples of the image bearing members include inorganic photoconductors such as amorphous silicon and selenium, and organic photoconductors (OPC) such as polysilane and phthalopolymethine. Among these, the amorphous silicon photoconductor is preferred in view of its long life.

The charging unit is not particularly limited and can be selected depending on the intended purpose. Examples of the charging units include a known contact charging device equipped with a conductive or semiconductive roller, a brush, a film and a rubber blade; a known noncontact charging device utilizing corona discharge such as corotron and scorotoron. The preferable charge unit is disposed to contact or noncontact with the image bearing member, and charges the surface of the image bearing member by superpositioning direct-current voltage and alternating-current voltage. The charging unit is a charging roller disposed adjacent to the image bearing member via a gap tape in order not to contact with each other, and a direct-current and alternating-current superposition voltage is preferably applied to the charging roller so as to charge the surface of the image bearing member.

The exposing unit is not limited as long as the surface of the image bearing member charged by the charging unit can be exposed imagewisely, and can be appropriately selected depending on the intended purpose. Examples thereof include various exposing devices, such as an optical copy device, a rod-lens-eye device, an optical laser device, and an optical liquid crystal shatter device. A backlight system may be also employed for exposure, where imagewise exposure is performed from the back side of the image bearing member.

The developing unit is not limited as long as the toner of the invention can be used and developed as a one-component developer, and can be appropriately selected from those known in the art depending on the intended purpose. Examples thereof include those having at least a developer bearing member which houses the toner of the invention, and can supply the toner contactingly or noncontactingly with the latent electrostatic image. The developing unit may be of dry developing type or wet developing type, and may be designed either for monochrome or multiple-color.

A primary transferring roller and a secondary transferring roller preferably contain at least a transferring unit configured to charge so as to separate the visible image from the image bearing member and to transfer onto a recording medium. The transferring unit may be used singly or in combination. Examples of the transferring units include a corona transferring device utilizing corona discharge, a transferring belt, a transferring roller, a pressure-transferring roller, and an adhesion-transferring device.

The intermediate transferring unit is not particularly limited and can be appropriately selected from the known transferring units. Examples thereof include a transferring belt.

The recording medium is not particularly limited and can be appropriately selected from the known recording medium, i.e. recording sheets.

The fixing unit is not particularly limited and can be appropriately selected depending on the intended purpose. However, the preferable fixing unit is configured to fix the image by heating and pressing using the known fixing member. The fixing member is preferably roller- or belt-shaped, and examples thereof include a combination of a heating roller and a pressurizing roller, or a combination of a heating roller, a pressurizing roller, and an endless belt. The heating temperature is preferably 80° C. to 200° C.

The fixing unit is not particularly limited and can be appropriately selected depending on the intended purpose. The fixing unit contains a heater equipped with a heating body, a film contacting with the heating body, and a pressing member press-contacting to the heating body via the film, and is configured to fix an unfixed image formed on the recording medium by heating and pressing while the recording medium passing between the film and the pressing member.

The known optical fixing device may be used with or in place of the fixing unit depending on the intended purpose.

The image-forming apparatus of the invention may also contain a charge eliminating unit, a recycling unit, and a controlling unit.

The charge eliminating unit is not particularly limited as long as it is capable of applying a charge eliminating bias to the image bearing member, and can be appropriately selected from those known depending on the intended purpose. Examples thereof include a charge eliminating lamp.

The recycling unit is not particularly limited and can be appropriately selected from the known conveyance systems.

The controlling unit is not particularly limited as long as the operation of each step can be controlled, and can be appropriately selected depending on the intended purpose. Examples thereof include equipments such as a sequencer and a computer.

The process cartridge of the present invention contains and supports integrally at least an image bearing member and a developing unit, and a cleaning unit configured to dispose a plate-like elastic blade adjacent to the surface of the image bearing member so as to clean the surface, and the process cartridge is detachably attached to the image-forming apparatus for one-component developer. The developing unit develops with the toner of the invention. The process cartridge of the invention may support integrally additional units which are selected appropriately.

EXAMPLES

Hereinafter, with referring to Examples and Comparative Examples, the invention is explained in detail and the following Examples and Comparative Examples should not be construed as limiting the scope of this invention. In Examples and Comparative Examples, all part(s) and percentage (%) are expressed by mass-basis unless indicated otherwise.

-Preparation for Resin H1-

First, 600 g of styrene, 110 g of butyl acrylate and 30 g of acrylic acid as vinyl monomers and 30 g of dicumyl peroxide as a polymerization initiator were put in a dropping funnel. Of polyester monomers, 1,230 g of polyoxypropylene(2.2)-2,2-bis(4-hydroxyphenyl)propane, 290 g of polyoxyethylene (2.2) -2,2-bis(4-hydroxyphenyl)propane, 250 g of isododecenyl-succinic anhydride, 310 g of terephthalic acid and 180 g of anhydrous 1,2,4-benzenetricarboxylic acid as polyols, 7 g of dibutyltin oxide as an esterification catalyst and 340 g (11.0 parts by mass relative to 100 parts by mass of feed monomer) of paraffin wax (melting point of 73.3° C., The endothermic peak during heating measured by a differential scanning calorimeter has a half width of 4° C.) as a wax were put in a 5L four-neck flask equipped with a thermometer, a stainless-steel agitator, a falling condenser and a nitrogen-introducing tube and a mixed solution of the vinyl monomer resin and polymerization initiator was allowed to drip from the dropping funnel for 1 hour while stirring at 160° C. in a nitrogen atmosphere inside the mantle heater. After maturing addition condensation reaction for 2 hours while still retaining the temperature of 160° C., condensation polymerization reaction was performed by heating at 230° C. The polymerization degree was tracked by the softening point measured by a constant-load extrusion, tubulus rheometer and the reaction was terminated at a desired softening point to obtain a resin H1. The softening point of the resin was 130° C.

-Preparation for Resin L1-

First, 2,210 g of polyoxypropylene(2.2)-2,2-bis (4-hydroxyphenyl)propane, 850 g of terephthalic acid and 120 g of anhydrous 1,2,4-benzenetricarboxylic acid as polyols, and 0.5 g of dibutyltin oxide as an esterification catalyst were put in a 5L four-neck flask equipped with a thermometer, a stainless-steel agitator, a falling condenser and a nitrogen-introducing tube and condensation polymerization reaction was performed by heating at 230° C. in a nitrogen atmosphere inside the mantle heater. The polymerization degree was tracked by a softening point measured by a constant-load extrusion, tubulus rheometer and the reaction was terminated at a desired softening point to obtain a resin L1. The softening point of the resin was 115° C.

-Preparation for Toner-

A masterbatch containing approximately 4 parts by mass of C. I. Pigment Red 57-1 was adequately mixed with 100 parts by mass (includes mass of internally-added wax) of a binder resin consisting of the Resin H1 and L1 using a HENSCHEL MIXER. It was then melt-kneaded using a two-axis extrusion kneader (PCM-30 manufactured by Ikegai Ltd.) of which the obtained product was rolled into a thickness of 2 mm using a cooling press roller and it was roughly pulverized by a feather mill after cooling on a cooling belt. And then it was pulverized to an average particle diameter of 10 μm to 12 μm using a mechanical pulverizer KTM (manufactured by Kawasaki Heavy Industries, Ltd.) and further pulverized while being subjected to coarse classification using a jet pulverizer IDS (manufactured by Nippon Pneumatic Mfg. Co., Ltd.) and to fine classification using a rotor classifier T Plex classifier, 100ATP (manufactured by Hosokawa Micron Corporation) so as to thereby obtain toner base particles.

The toner base particle had the volume average particle diameter of 7.8 μm and the average circularity of 0.92.

As shown in Table 1, in Examples 1 to 4 and Comparative Examples 1 to 9, a certain mass of silica 1 and silica 2 were added to 100 parts by mass of the toner base particles, and mixed by means of a HENSCHEL MIXER FM10B (manufactured by Mitsui Miiuke Machinery Co., Ltd.) to obtain a magenta toner. In Table 1, the amount of the wax is the mass ratio of the releasing agent to the binder resin.

TABLE 1

| | Amount of wax | Adhesive force among toners (g) | | Adhesive force of the inorganic particles to the toner base particles | Mixing process | | | | | | |
|---|---|---|---|---|---|---|---|---|---|---|---|
| | | | | | Average primary particle diameter of silica 1 | Additive amount of silica 1 (parts by | Average primary particle diameter of silica 2 | Additive amount of silica 2 (parts by | Stirring | Process temperature | Process time |
| | (mass %) | 25° C. | 55° C. | (%) | (nm) | mass) | (nm) | mass) | blade | (° C.) | (min.) |
| Ex. 1 | 3.2 | 28 | 46 | 32 | 15 (*1) | 1.0 | 35 (*4) | 2.0 | ST | 20 | 25 |
| Ex. 2 | 5.0 | 53 | 78 | 44 | 15 (*1) | 1.0 | 35 (*4) | 2.0 | ST | 35 | 18 |
| Ex. 3 | 5.5 | 59 | 80 | 58 | 15 (*1) | 1.0 | 35 (*4) | 2.0 | ST | 40 | 10 |
| Ex. 4 | 5.0 | 41 | 79 | 46 | 18 (*2) | 3.0 | — | — | ST | 35 | 18 |
| Comp. Ex. 1 | 2.5 | 25 | 30 | 29 | 15 (*1) | 1.0 | 35 (*4) | 2.0 | ST | 20 | 25 |
| Comp. Ex. 2 | 5.5 | 76 | 95 | 26 | 15 (*1) | 1.0 | 35 (*4) | 2.0 | ST | 25 | 20 |
| Comp. Ex. 3 | 6.5 | 88 | 180 | 28 | 15 (*1) | 1.0 | 35 (*4) | 2.0 | ST | 25 | 30 |
| Comp. Ex. 4 | 5.0 | 72 | 153 | 76 | 18 (*2) | 2.3 | — | — | ST | 35 | 25 |
| Comp. Ex. 5 | 5.0 | 34 | 81 | 66 | 15 (*1) | 2.2 | 35 (*4) | 4.0 | Y | 35 | 21 |
| Comp. Ex. 6 | 5.0 | 55 | 92 | 61 | 7 (*3) | 1.0 | 35 (*4) | 2.0 | ST | 35 | 23 |
| Comp. Ex. 7 | 5.0 | 53 | 82 | 68 | 15 (*1) | 1.0 | 100 (*5) | 2.0 | Y | 35 | 20 |

TABLE 1-continued

| | Amount of wax | Adhesive force among toners (g) | | Adhesive force of the inorganic particles to the toner base particles | Mixing process | | | | | | |
|---|---|---|---|---|---|---|---|---|---|---|---|
| | | | | | Average primary particle diameter of silica 1 | Additive amount of silica 1 (parts by | Average primary particle diameter of silica 2 | Additive amount of silica 2 (parts by | Stirring | Process temperature | Process time |
| | (mass %) | 25° C. | 55° C. | (%) | (nm) | mass) | (nm) | mass) | blade | (° C.) | (min.) |
| Comp. Ex. 8 | 5.0 | 61 | 106 | 61 | 15 (*1) | 0.5 | 100 (*5) | 2.5 | Y | 35 | 20 |
| Comp. Ex. 9 | 5.0 | 77 | 102 | 63 | 15 (*1) | 2.0 | 100 (*5) | 1.0 | Y | 35 | 20 |

(*1) R202 NIPPON AEROSIL CO., LTD.
(*2) H 1303 Clariant Japan K.K.
(*3) TG811 Cabot Japan K.K.
(*4) RX50 NIPPON AEROSIL CO., LTD.
(*5) X24 Shin-Etsu Chemical Co., Ltd.

The amount of the wax is the percentage relative to the binder resin, and the stirring blades ST and Y were optional blade (manufactured by Mitsui Miiuke Machinery Co., Ltd.), and AO blade (manufactured by Mitsui Miiuke Machinery Co., Ltd.) was used as a lower blade in all Examples and Comparative Examples.

<Evaluation Method and Result>

The images printed with the magenta toner in Examples 1 to 4, and Comparative Examples 1 to 9 by means of a color laser printer IPSiO 3000 (manufactured by Ricoh Company, Ltd.) were evaluated.

The evaluation items and standards are as follows:

(1) Separation Property

Through duration, and environment, the paper transferring property were visually observed and evaluated.

(2) Residual Toner

The streaks on the image caused by the residual toner were visually observed and evaluated. At the same time, the blade was visually observed and evaluated.

(3) Streaky Image

The streaky images caused by the toner stuck on the control part were visually observed and evaluated. At the same time, the blade was visually observed and evaluated.

"A" denotes acceptable quality, and "B" denotes quality failure.

The results are shown in Table 2.

TABLE 2

| | Separation property | Residual toner | Streaky image |
|---|---|---|---|
| Example 1 | A | A | A |
| Example 2 | A | A | A |
| Example 3 | A | A | A |
| Example 4 | A | A | A |
| Comparative Example 1 | B | A | A |
| Comparative Example 2 | A | B | B |
| Comparative Example 3 | A | B | B |
| Comparative Example 4 | A | B | B |
| Comparative Example 5 | A | B | B |
| Comparative Example 6 | A | B | B |
| Comparative Example 7 | A | A | B |
| Comparative Example 8 | A | B | B |
| Comparative Example 9 | B | B | A |

What is claimed is:

1. A pulverized toner comprising:

toner base particles wherein the toner base particles comprise at least a binder resin, a colorant, and a releasing agent, and the mass ratio of the releasing agent to the binder resin is 3.0% to 6.0%, wherein the adhesive force among the pulverized toners at 25° C. to 55° C. is 400 $N/m^2$ to 1600 $N/m^2$, wherein the ratio of the adhesive force among the pulverized toners at 55° C. to the adhesive force among the pulverized toners at 25° C. is 1.4 to 2.5.

2. The pulverized toner according to claim 1, wherein a volume average particle diameter of the toner base particles is 6 μm to 10 μm, and an average circularity of the toner base particles is 0.900 to 0.930.

3. The pulverized toner according to claim 1, further comprising:

inorganic particles, wherein the amount of the inorganic particles is 2.5 mass% to 6.0 mass%.

4. The pulverized toner according to claim 3, wherein the inorganic particles comprise a silica having an average primary particle diameter of 10 nm to 60 nm.

5. The pulverized toner according to claim 3, wherein the inorganic particles comprise a first silica having an average primary particle diameter of 10 nm to 20 nm, and a second silica having an average primary particle diameter of 25 nm to 60 nm.

6. The pulverized toner according to claim 5, wherein the mass ratio of the first silica to the second silica is 1/4 to 2/3.

7. The pulverized toner according to claim 3, wherein an adhered amount of the inorganic particles to the toner base particles after processing, including separating, washing, and drying, is 30% to 60% of that before the processing.

8. The pulverized toner according to claim 1, wherein the ratio of the adhesive force among the pulverized toners at 55° C. to the adhesive force among the pulverized toners at 25° C. is 1.5 to 2.5.

9. The pulverized toner according to claim 1, wherein the ratio of the adhesive force among the pulverized toners at 55° C. to the adhesive force among the pulverized toners at 25° C. is 1.6 to 2.5.

10. The pulverized toner according to claim 1, wherein the ratio of the adhesive force among the pulverized toners at 55° C. to the adhesive force among the pulverized toners at 25° C. is 1.9 to 2.5.

* * * * *